US006104353A

United States Patent [19]

Diamond et al.

[11] Patent Number: 6,104,353

[45] Date of Patent: Aug. 15, 2000

[54] LOCAL TELEVISION ANTENNA SYSTEM FOR USE WITH DIRECT BROADCAST SATELLITE TELEVISION SYSTEMS

[75] Inventors: Robert L. Diamond, Bedford; Glenn D. Slovenko, Hartsdale, both of N.Y.; Kent Britain, Grand Prairie, Tex.

[73] Assignee: RDI Electronics, Inc., Valhalla, N.Y.

[21] Appl. No.: 09/106,749

[22] Filed: Jun. 30, 1998

[51] Int. Cl.[7] ..... H01Q 21/00; H01Q 11/12

[52] U.S. Cl. ..... 343/725; 343/742; 343/867; 343/879

[58] Field of Search ..... 343/725–729, 343/741, 742, 866, 867, 878, 879, 893, DIG. 2; H01Q 21/00, 11/12

[56] References Cited

U.S. PATENT DOCUMENTS

| | | | |
|---|---|---|---|
| 3,820,117 | 6/1974 | Hall et al. | 343/895 |
| 5,402,138 | 3/1995 | Hulett et al. | 343/851 |
| 5,457,469 | 10/1995 | Diamond et al. | 343/895 |
| 5,604,508 | 2/1997 | Atkinson | 343/879 |
| 5,933,123 | 8/1999 | Kaul | 343/879 |

*Primary Examiner*—Don Wong
*Assistant Examiner*—Hoang Nguyen
*Attorney, Agent, or Firm*—Morgan, Lewis & Bockius LLP

[57] ABSTRACT

A local television antenna system for use with a satellite television system includes an omnidirectional antenna, a support structure for mounting the omnidirectional antenna to a satellite television dish support, and receiving circuitry mounted to the omnidirectional antenna. The omnidirectional antenna includes an antenna plate, having electrical circuit paths formed thereon, and first and second antennas having curled ends. The support structure includes a integrally-molded double clamp for providing a mechanically strong coupling to the satellite television dish support and first and second brackets for mounting to the omnidirectional antenna to provide a mechanically strong coupling. The receiving circuitry is shielded to limit interference and includes filter and amplification circuitry and one or more diplexers for combining a received local television signal with a received satellite television signal.

16 Claims, 16 Drawing Sheets

LOCAL TELEVISION ANTENNA SYSTEM FOR USE WITH DIRECT BROADCAST SATELLITE TELEVISION SYSTEMS

BACKGROUND OF THE INVENTION

1. Field of the Invention

The present invention relates to a local television antenna system for use with a direct broadcast satellite television system.

2. Description of the Prior Art

Satellite television systems have emerged as an alternative to cable television systems. In recent years, the huge C-band parabolic antennas previously used in satellite television systems have given way to mini-dish receivers used in direct broadcast satellite (DBS) systems, which typically range in size from 18–36 inches in diameter. These commercial mini-dish antennas are not only more affordable to consumers, but are less obtrusive than the old C-band antennas. Despite numerous advantages of DBS systems, more consumers currently subscribe to cable television services than DBS services. One reason is that DBS systems are unable to provide local programming, such as local news and sports, that customers have come to expect.

Many attempts to provide local programming in conjunction with DBS systems have been awkward, complex, incomplete, and/or expensive. For example, one solution has been to subscribe to DBS service as well as cable service. However, this solution is too expensive for the majority of consumers.

RDI Electronics, Inc. of Valhalla, N.Y. has provided a solution which is shown in FIG. 1. As shown, an omnidirectional local antenna 10 is mounted to one end of a support pipe 20 using a bracket. The local antenna 10 includes an antenna plate 12 having two curved dipoles 14 and 16 extending from the antenna plate 12. The other end of support pipe 20 is fixed to a support pipe 32 holding a satellite dish 30. A double clamp 40 (made by spot-welding two pipe clamps) couples local antenna support pipe 20 to satellite dish support pipe 32. Circuitry 50, including a single diplexer, is mounted to the antenna plate 12. Circuitry 50 amplifies the received local broadcast television signals received by antenna 10 and combines the local broadcast television signals with the satellite service signals received by the satellite dish 30. The output of circuitry 50 is provided on a coaxial cable 60 to diplexer 70 located within the subscriber's home. Diplexer 70 separates the local broadcast television signals from the satellite signals and provides the separated signals to appropriate ports of a satellite receiver 80.

While the system shown in FIG. 1 produces satisfactory results, further advances may be made to improve, among other things, the mechanical strength of the structure and the quality of the received signal.

SUMMARY OF THE INVENTION

The present invention has been made in view of the above circumstances and has as an object to provide a simple, inexpensive, and reliable local antenna system.

A further object is to provide a simple, inexpensive, and reliable local antenna system having improved structural strength.

A further object is to provide simple, inexpensive, and reliable local antenna system having improved signal quality.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a local television antenna including an omnidirectional antenna for receiving a local broadcast television signal, a mounting support for mounting the omnidirectional antenna to a mounting support for a satellite television dish, the mounting support comprising a integrally-molded double clamp, and local broadcast television receiving circuitry for processing the local broadcast television signal. The receiving circuitry includes a diplexer for combining the processed local broadcast television signal with a satellite television signal to produce a composite signal.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiment(s) of the invention and together with the description, serve to explain the principles of the invention.

DESCRIPTION OF THE PREFERRED EMBODIMENT

Reference will now be made in detail to the present exemplary embodiment(s) of the invention illustrated in the accompanying drawings. Wherever possible, the same reference numbers will be used throughout the drawings to refer to the same or like parts.

Figure 1:
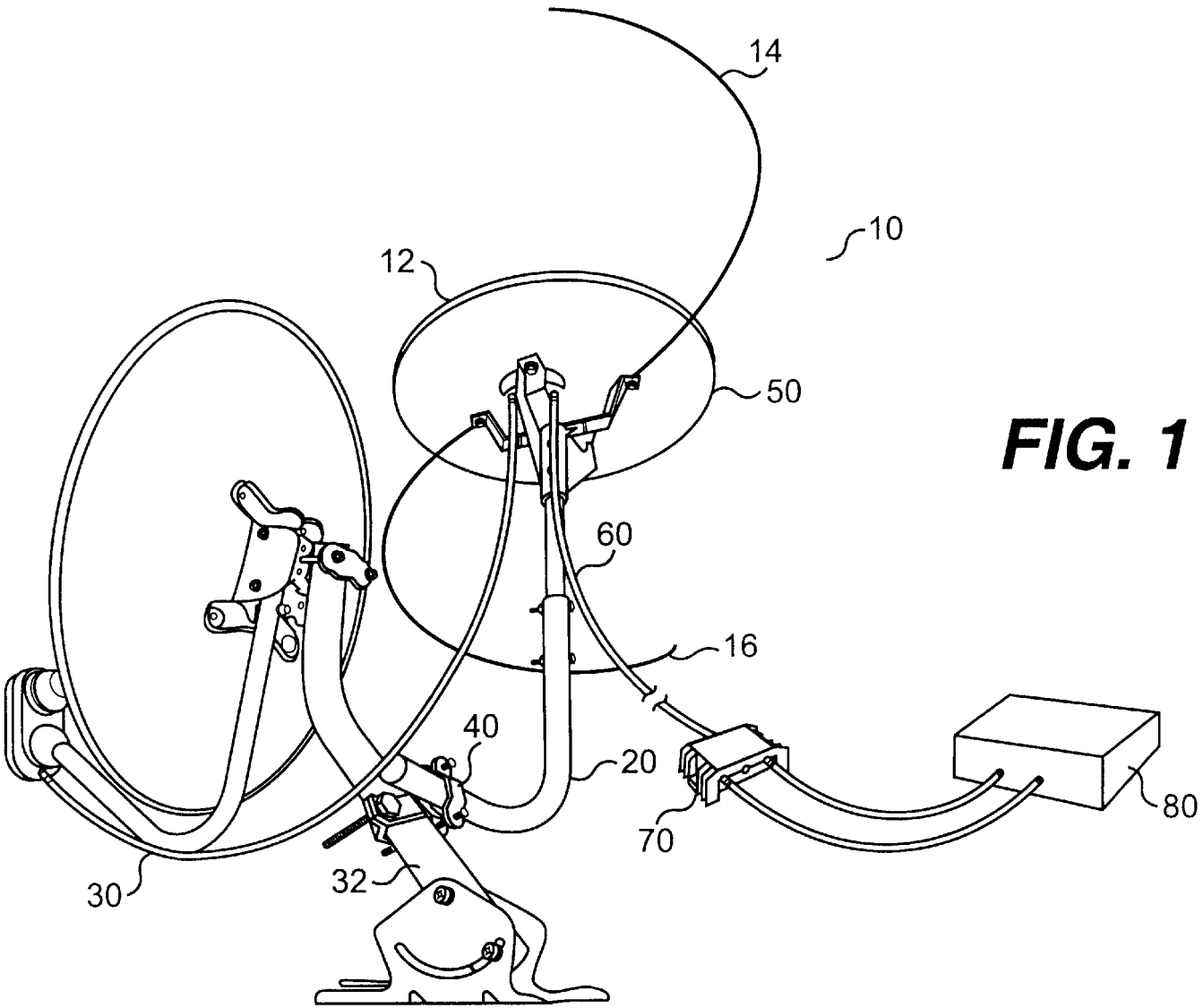
FIG. 1 illustrates a conventional local television antenna system for use with a DBS television receiver system.
Figure 2:
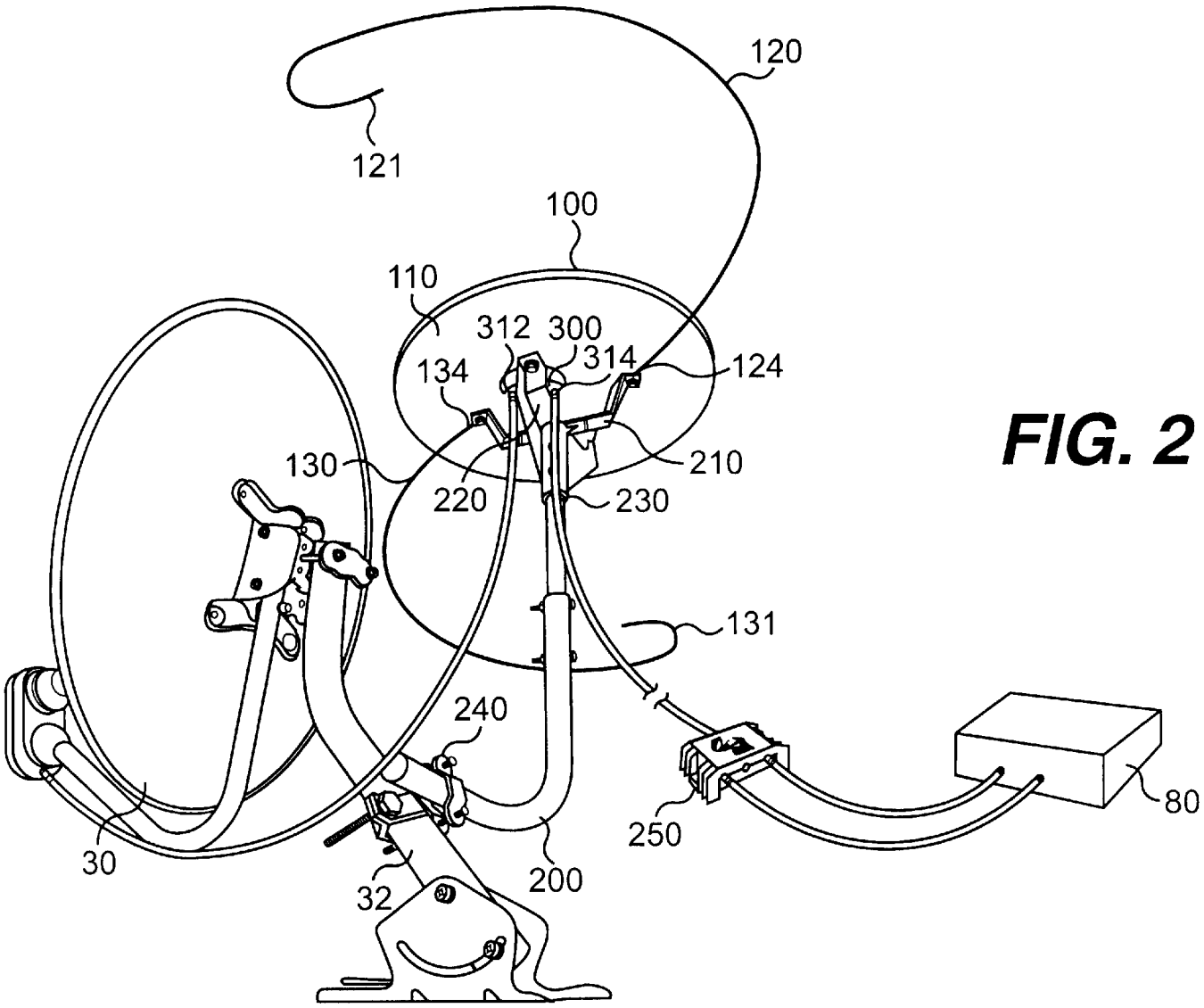
FIG. 2 illustrates an improved local television antenna system for use with a DBS television receiver system in accordance with the present invention.

FIG. 2 illustrates an embodiment of a local television antenna system for use with a satellite television receiver system in accordance with the present invention. The local television antenna system includes an omnidirectional antenna 100, support structure 200 for mounting the antenna to a support pipe 32 of a satellite dish structure 30, and receiving circuitry 300 mounted to the omnidirectional antenna 100.

As shown in FIG. 2, the omnidirectional local antenna 100 includes an antenna plate 110, a first antenna 120 extending from the antenna plate 110, and a second antenna 130 extending from the antenna plate 110 in a direction generally opposite that of the first antenna 120. Of course, additional antennas may be provided and/or arranged symmetrically or asymmetrically with respect to the antenna plate 110. The antenna plate 110 may include a flat housing or have a dish-shaped housing that may be made of, for example, a weather resistant plastic such as Acrylonitrile Butadiene Styrene (ABS) or another suitable material. FIG. 2 shows antenna plate 110 to be round, but other shapes are also possible. As discussed in greater detail below, the antenna plate 110 includes one or more wiring paths 140 (not shown in FIG. 2). The wiring paths 140 may be provided in loop patterns, as will be discussed in greater detail below, that serve as antenna elements.

Each of the first and second antennas 120 and 130 has a generally curved shape and curled end portions 121 and 131. Ends 124, 134 of the antennas 120, 130 opposite the curled end portions 121, 131 may be secured to the antenna plate 110, as discussed in greater detail below.

Support structure 200 includes first and second mounting brackets 210 and 220, a support pipe 230, and an integrally-molded double clamp 240. The first and second brackets 210, 220 secure a first end of support pipe 230 to antenna plate 110, for example, using bolts, nuts screws, clips or other fasteners. First bracket 210 may be used to secure the first and second antenna 120, 130 to the antenna plate 110. Second bracket 220 may be secured to the antenna plate 110 at an approximately right angle to the first bracket 210 to provide additional stability. The integrally-molded double clamp 240 clamps a second end of support pipe 230 to the support pipe 32 of satellite dish 30.

Receiving circuitry 300 is preferably provided on a circuit board 310 built into or housed within the antenna plate 110. Alternatively, the circuit board 310 may be secured to the antenna plate 110, or may be coupled to the antenna plate 110 via wire or cable, for example. The wiring paths 140 of the antenna plate 110 may be used to route signals from the antennas 120 and 130 to the circuit board 310. Receiving circuitry 300 may include filter and amplifier elements for filtering and amplifying local television signals received from the omnidirectional antenna 100 and a diplexer element for combining the local television signals with satellite television signals received by the satellite dish 30.

As shown in FIG. 2, the circuit board 310 may have two connectors 312 and 314, which may be, for example, coaxial connectors. Connector 312 is adapted to receive a coaxial cable or other signal path from the satellite dish 30. Connector 314 is adapted to output a composite signal including the combined local broadcast television signals and satellite television signals. The composite signal may be communicated from the connector 314 to a satellite receiver 80 or set top box inside a subscriber's home via a coaxial cable or other suitable signal path. For example, a coaxial cable or other suitable signal path from the receiving circuitry 300 may be supplied to a diplexer 250 which separates the local television signal from the satellite television signal. The separated signals may be supplied to the satellite receiver or set top box via separate cables and/or wires. Circuit board 310 may further include one or more additional connector pairs, each for receiving an additional satellite television signal input and for outputting an additional composite signal, including combined local broadcast television signals and satellite television signals.

Figure 3:
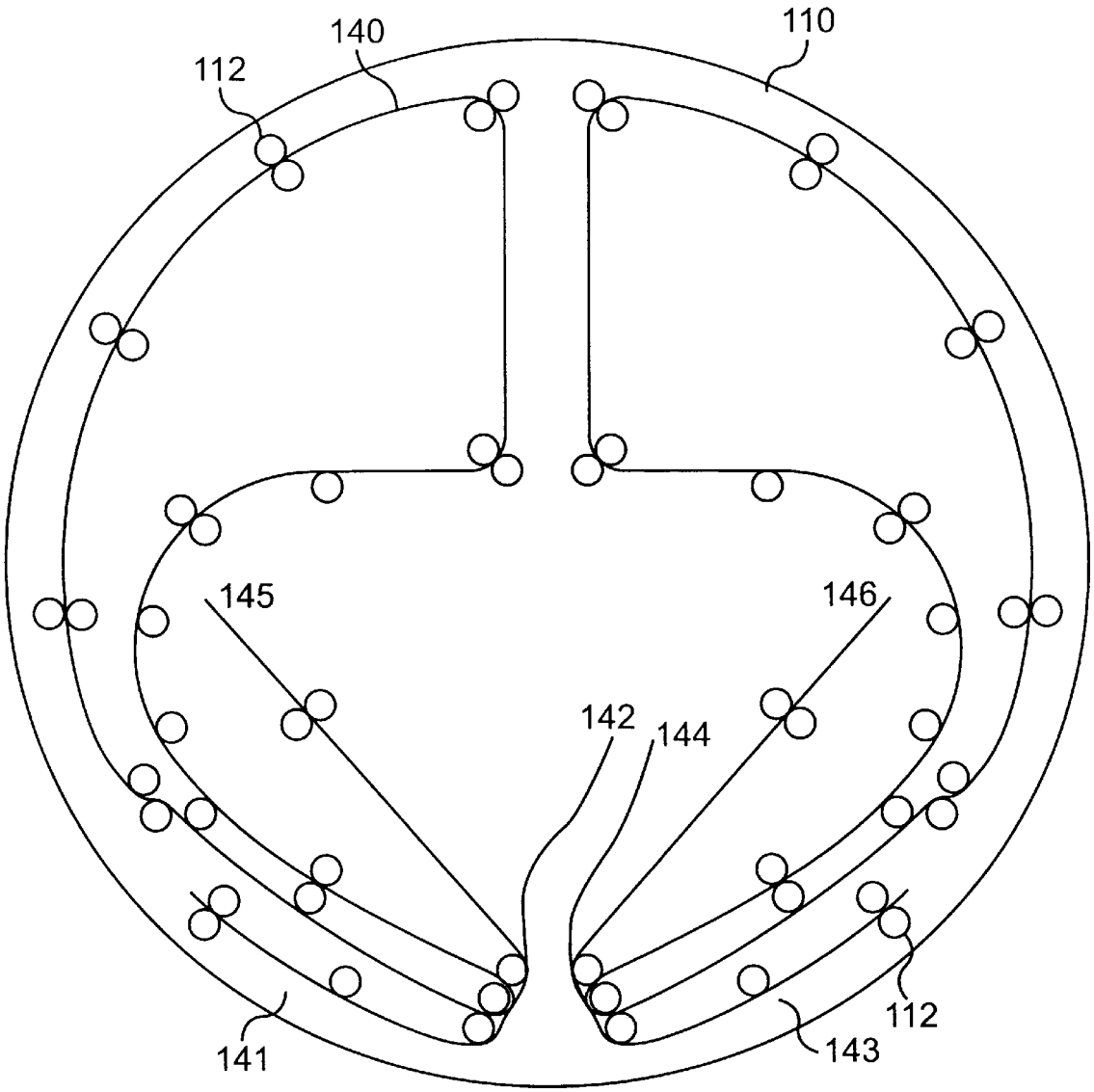
FIGS. 3, 4, 5A and 5B illustrate features of an antenna plate for use in the local television antenna system in accordance with the present invention.

FIG. 3 illustrates the antenna plate 110 including electrical path wiring arrangement 140. As shown, the wiring paths 140 may comprise two separate wiring paths 141 and 143. The wiring paths 141 and 143 may be formed by threading wire or other electrically conductive a material through bosses 112 extending from a surface of antenna plate 110. As shown in FIG. 3 by way of example, wiring paths 141 and 143 may be arranged to form antenna loops to enhance reception of local broadcast television signals. These wiring paths 141 and 143 terminate physically at straight ends 145 and 146, respectively. This wiring arrangement 140 is configured in a modified bow tie antenna arrangement designed to optimize the omnidirectional effects and maximize reception sensitivity for VHF high frequency. This wiring arrangement 140 also allows for increased economy of the spatial layout of the wiring paths.

Figure 4:
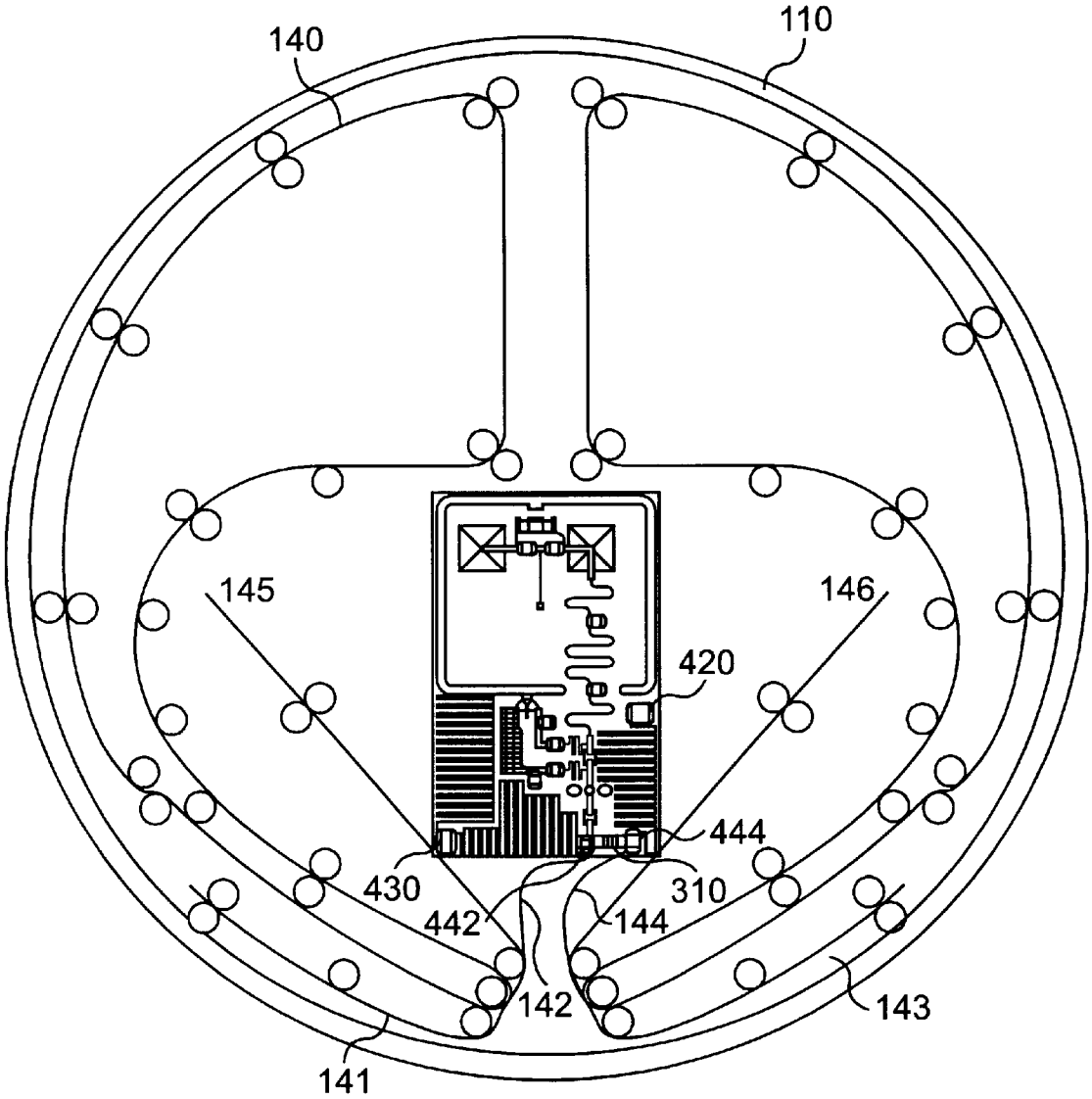

Wiring paths 141 and 143 include leads 142 and 144, respectively, for connecting to contacts 442 and 444, respectively, of circuit board 310 as shown in FIG. 4 which illustrates antenna plate 110, including wiring paths 140, with circuit board 310 mounted thereon. First antenna 120 is coupled, for example, to circuit board contact 420 while second antenna 130 is coupled, for example, to circuit board contact 430.

Figure 5A:
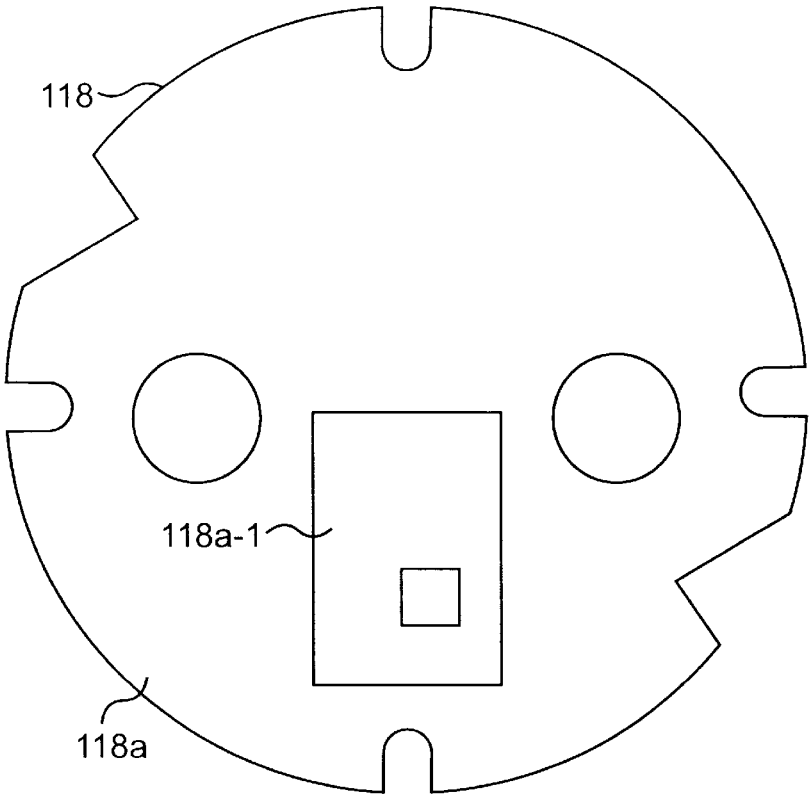
Figure 5B:
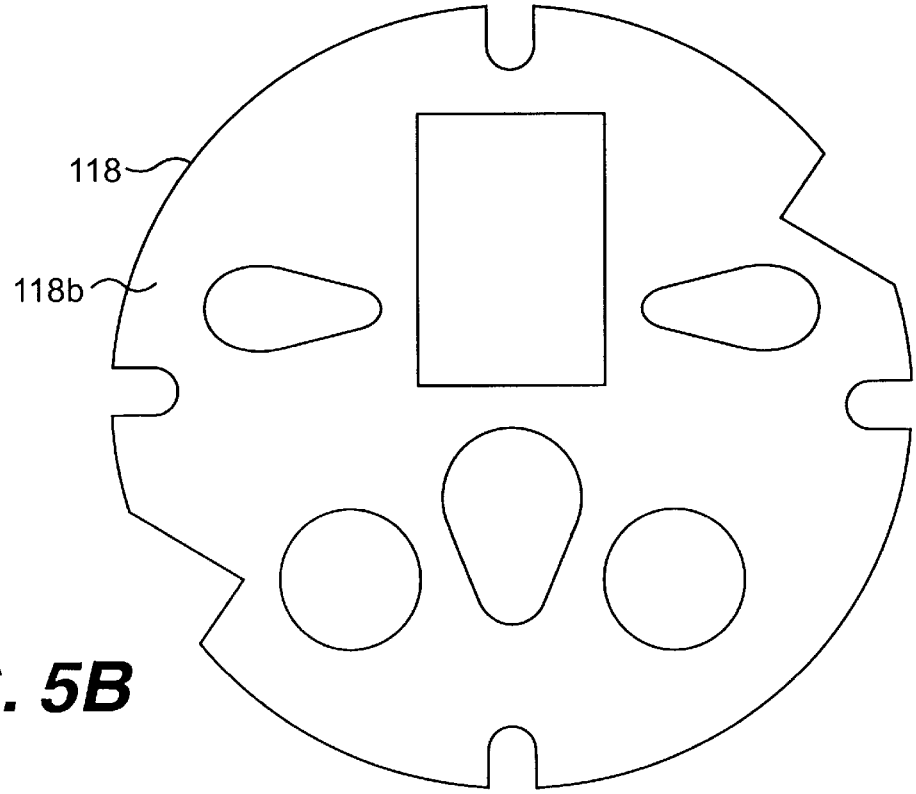

Antenna plate 110 may further include a cavity filler 118, as shown in FIGS. 5A and 5B. FIG. 5A illustrates a first side 118*a* of cavity filler 118 and FIG. 5B illustrates a second side of cavity filler 118*b*. Cavity filler 118 is inserted into a cavity formed in antenna plate 110. As illustrated in FIGS. 5A and 5B, the surface of cavity filler 118 may be shaped to accommodate structures or topographies within antenna plate 110. For example, as shown in FIG. 5A, the first side 118*a* of cavity filler 118 may have an indentation 118*a*-1 shaped to accommodate circuit board 310. Cavity filler 118 stiffens the antenna plate 110 to better stabilize the antenna plate 110 and components housed within the antenna plate 110 against damage caused, for example, by adverse weather conditions or forces. The cavity filler 118 further prevents moisture from entering the antenna plate 110 that may corrode or otherwise damage the electronics housed by the antenna plate 110. The cavity filler 118 may be made, for example, of Styrofoam or another suitable material.

Figure 6:
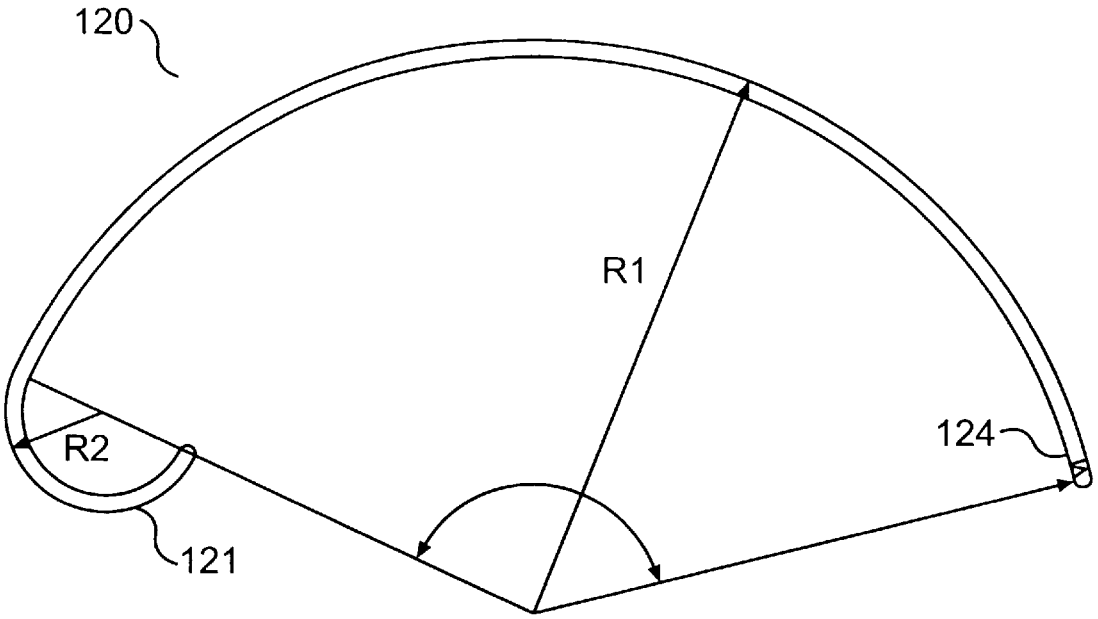
FIG. 6 illustrates an embodiment of an antenna for use with the local television antenna system in accordance with the present invention.
Figure 7:
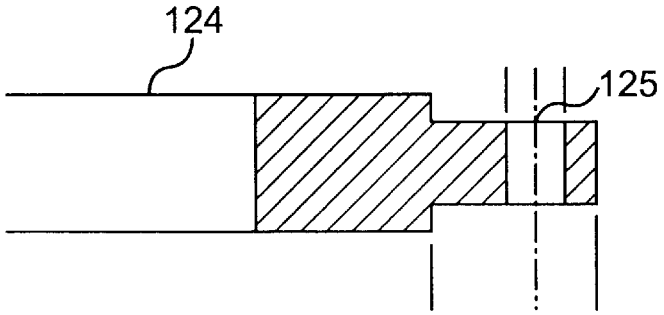
FIG. 7 illustrates a cross section of an end of the antenna shown in FIG. 4.

FIG. 6 illustrates first antenna 120 of the omnidirectional antenna 100 in accordance with the present invention. Second antenna 130 or additional antennas, if desired, may be similarly configured. FIG. 7 is a cross-sectional view of the end 124 of the antenna 120 shown in FIG. 6. As shown, antenna 120 is generally curved or arcuate. For example, antenna 120 may about 880 mm long and curved in a radius R1 of about 313 mm. Of course, antenna 120 may be configured with a different length and/or radius of curvature. Antenna 120 has a curled end 121 and an end 124 opposite the curled end 121. The curled end 121 may have a radius of curvature R2, for example, of 50.8 mm. End 124 may be flat, for example. As shown in greater detail in FIG. 7, end 124 includes an aperture 125 extending transversely through the antenna 120. The aperture 125 may accommodate a screw, bolt, or other fastening device for securing antenna 120 to the antenna plate 110.

Figures 8A, 8B, 8C:
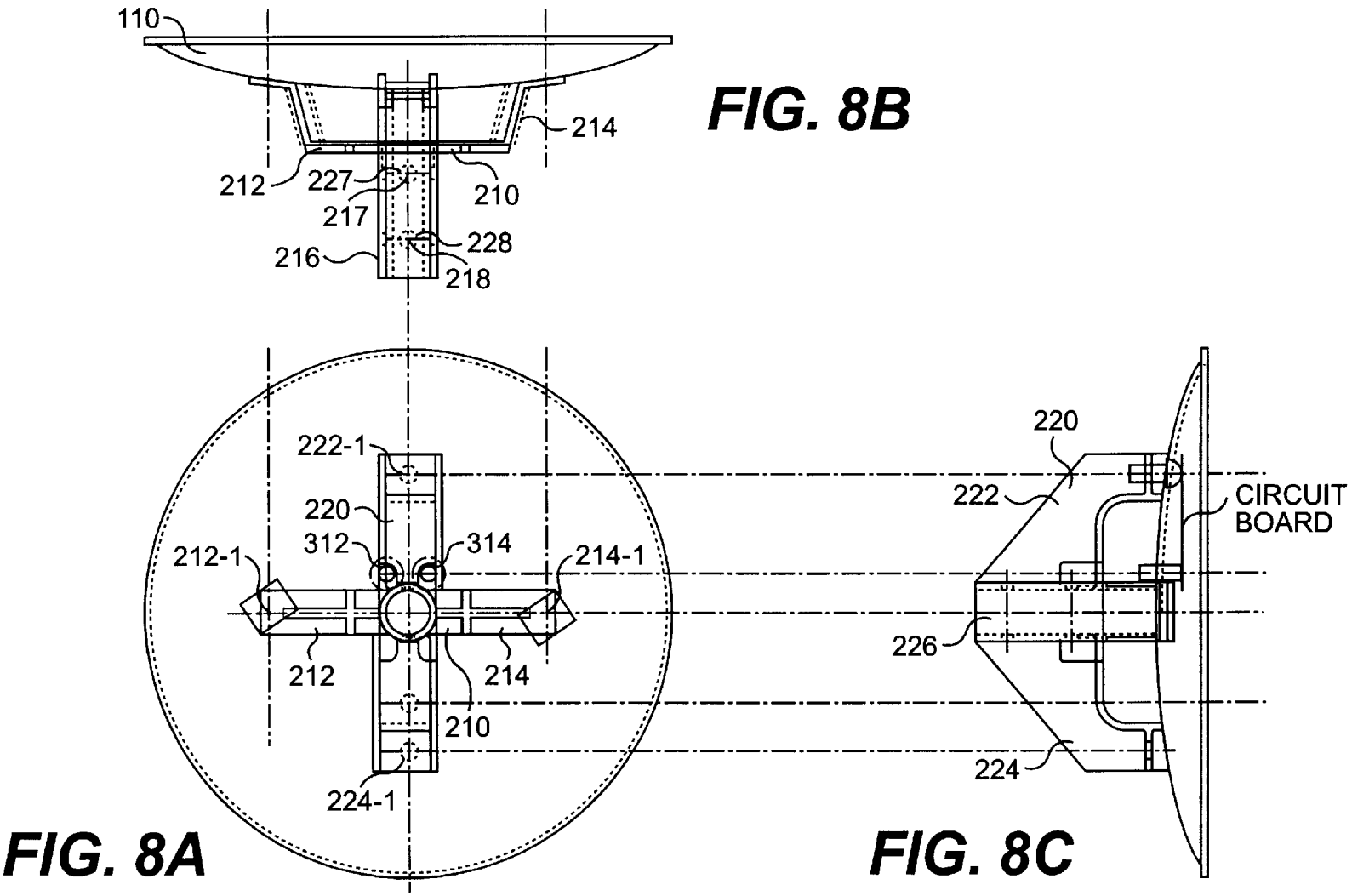
FIGS. 8A–8C, 9 and 10 illustrate mounting brackets for mounting to an antenna plate in accordance with the present invention.
Figure 9:
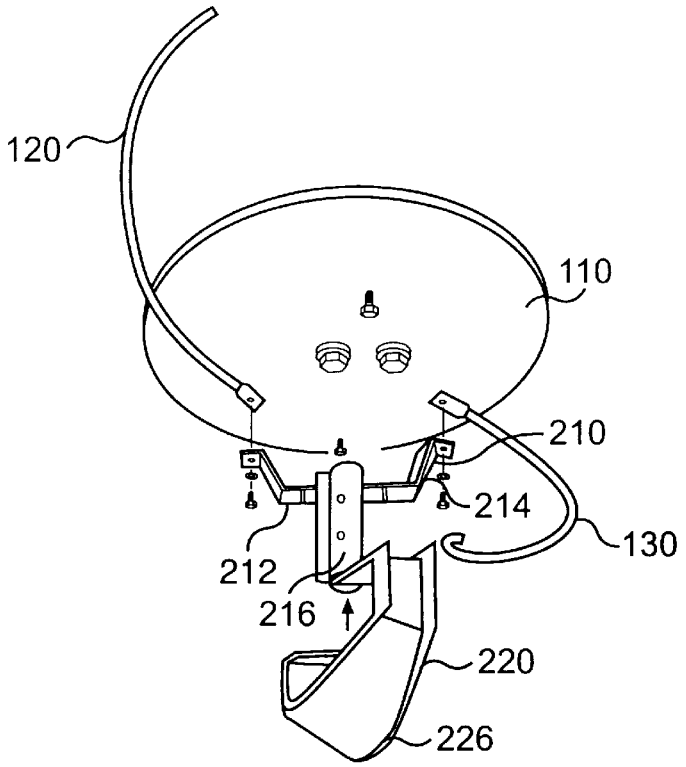

FIGS. 8A–8C, 9 and 10 illustrate a mounting arrangement whereby first and second brackets 210 and 220 mount to antenna plate 110. FIGS. 11 and 12 illustrate second bracket 220. As shown in FIGS. 8A–8C and 9, first bracket 210 has two leg extensions 212 and 214 that mount to antenna plate 110. Leg extensions 212 and 214 join together at a barrel or sleeve 216 adapted to receive an end of support pipe 230. Leg extensions 212 and 214 may have holes 212-1 and 214-1, respectively, for receiving bolts or other connectors mounted on antenna plate 110. The apertures at the ends 124, 134 of antennas 120, 130 may be fit over the bolt or other connector before holes 212-1 and 214-1 are fit over the same. Accordingly, as shown in FIG. 9, nuts may be fastened to the bolts to secure the leg extensions 212, 214 and the first and second antennas 120 and 130 to the antenna plate 110. Of course, antennas 120 and 130 may be separately mounted to the antenna plate 110.

Referring to FIGS. 8A–8C, 9, 10, 11, and 12, second bracket 220 include leg extensions 222 and 224, and a barrel or sleeve 226 that fits over sleeve 216 of first bracket 210. Similar to first bracket 210, leg extensions 222 and 224 of second bracket 220 may include holes 222-1 and 224-1 to facilitate attachment to antenna plate 110. As shown, leg extensions 222 and 224 mount to antenna plate 110 substantially transversely to leg extensions 212 and 214, for example, at a right angle. To further enhance the mechanical strength of bracket 220, leg extensions 222 and 224 may flair from sleeve 226 as shown in FIGS. 8C and 12, for example. Sleeves 216 and 226 include vertically spaced holes 217, 218, 227, and 228. Holes 217, 218, 227, and 228 communicate with corresponding holes formed in the end of support pipe 230.

Figure 10:
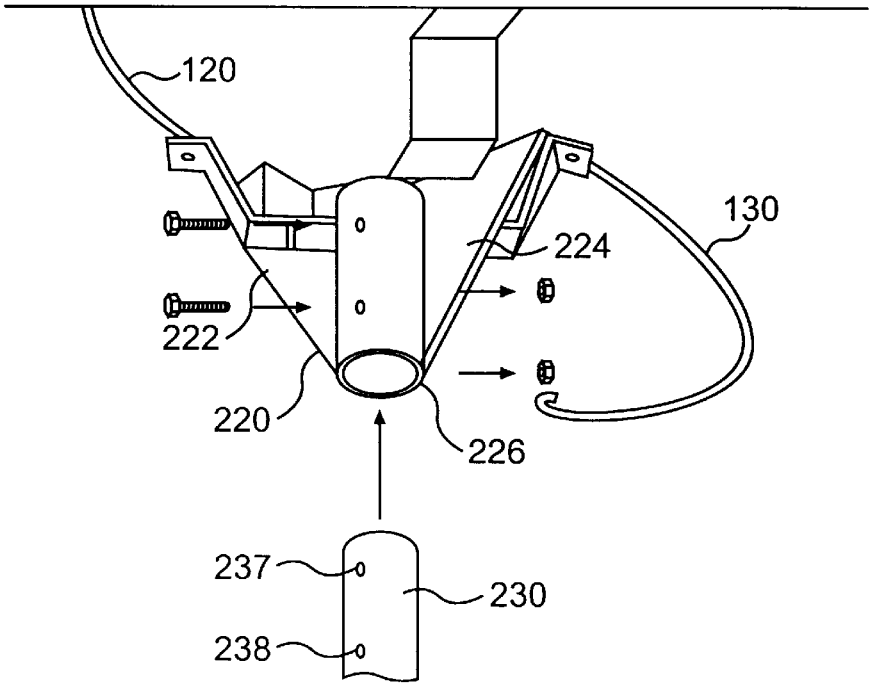
Figures 11, 12:
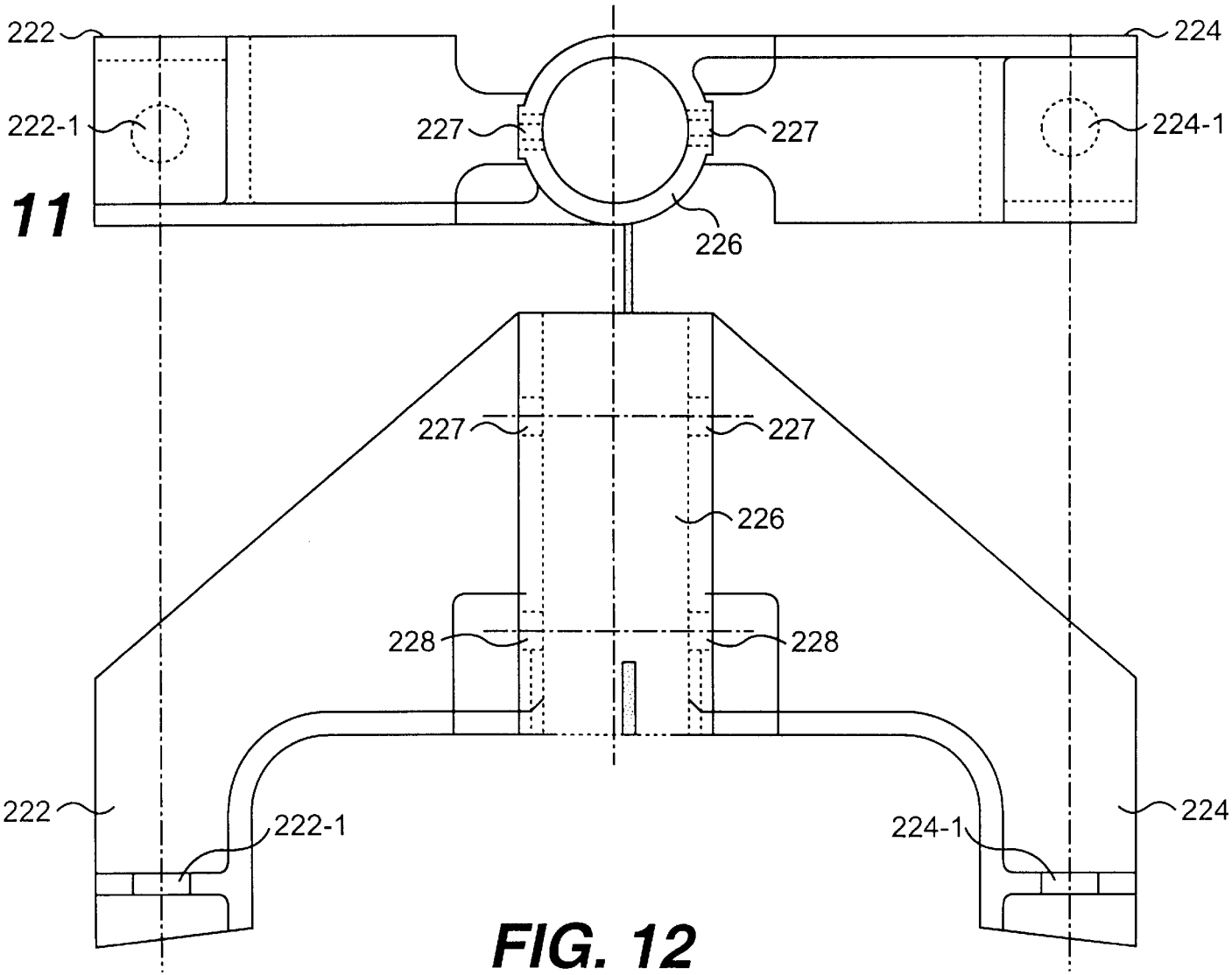
FIGS. 11 and 12 illustrate an embodiment of a mounting bracket in accordance with the present invention.

As shown in FIG. 10, first and second brackets 210 and 220 may be secured to support pipe 230 by inserting bolts or pins through holes 217, 227, and corresponding holes 237 in support pipe 230 and through holes 218, 228 and corresponding holes 238 in support pipe 230. In this way, brackets 210 and 220 provide an extremely strong mechanical connection between support pipe 230 and omnidirectional antenna 100 that is capable of withstanding high loads due to wind or other forces.

Figure 13:
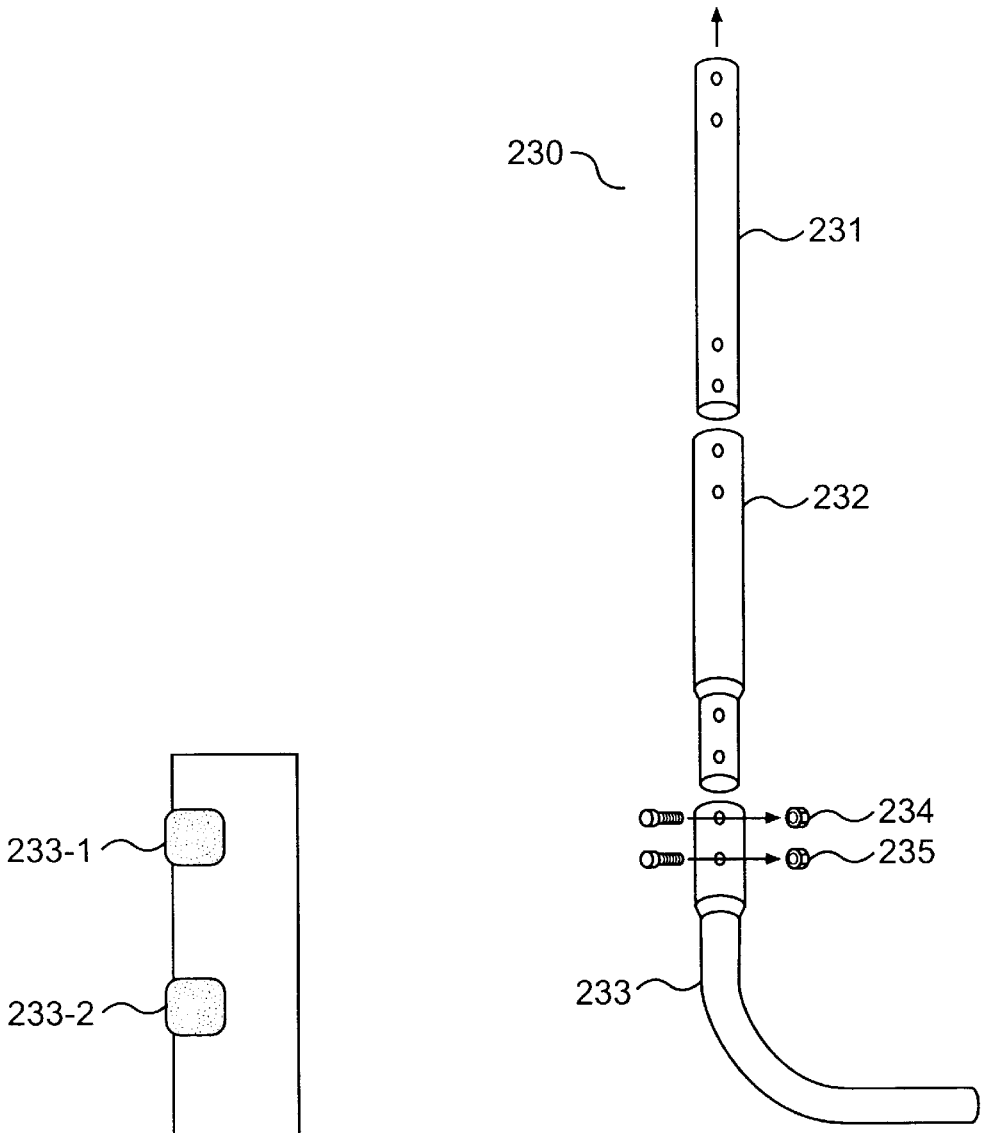
FIG. 13 illustrates a support pipe in accordance with the present invention.

FIG. 13 provides an exploded view of support pipe 230. As shown, support pipe 230 includes three parts: a bracket pipe 231, an extension pipe 232, and an L-shaped pipe 233. Bracket pipe 231 fits in bracket sleeves 216, 226 to couple the support pipe 230 to the antenna plate 110. Extension pipe 232 couples between bracket pipe 231 and L-shaped pipe 233. Extension pipe 232 enables the height of the omnidirectional antenna 100 to be adjusted to permit better reception and to allow proper operation and fit in a variety of different locations. Extension pipe 232 is not necessary and bracket pipe 231 and L-shaped pipe 233 may be adapted to connect together without extension pipe 232 intervening.

Bracket pipe 231 and extension pipe 232 may have holes formed through them for receiving bolts, pins, or other fasteners for coupling. Of course, other types of connections may be used to secure bracket pipe 231 to extension pipe 232.

Figure 14:
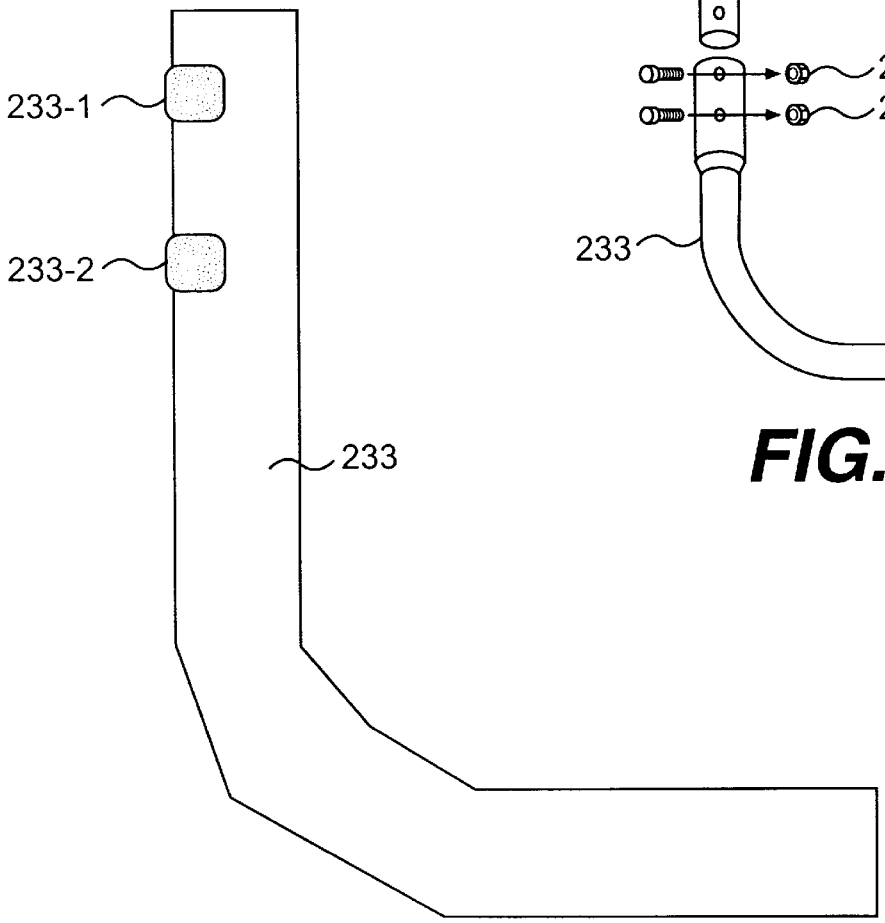
FIG. 14 illustrates an L-shaped pipe in accordance with the present invention.

FIG. 13 shows that extension pipe 232 can be coupled to L-shaped pipe 233 using nut and bolt pairs 234 and 235. As shown in FIG. 14, L-shaped pipe 233 may include horizontal slots 233-1 and 233-2 for communicating with holes formed in extension pipe 232. Horizontal slots 233-1 and 233-2 permit extension pipe 232 to be rotated relative to L-shaped pipe 233. This allows a user to adjust rotatably the direction of omnidirectional antenna 100. Horizontal slots may be provided instead of holes on extension pipe 232, bracket pipe 231, and the first and second brackets 210 and 220 to permit rotation. Of course, other mechanisms may be provided to permit rotational or translational adjustment in any number of rotational and linear directions.

Figure 15:
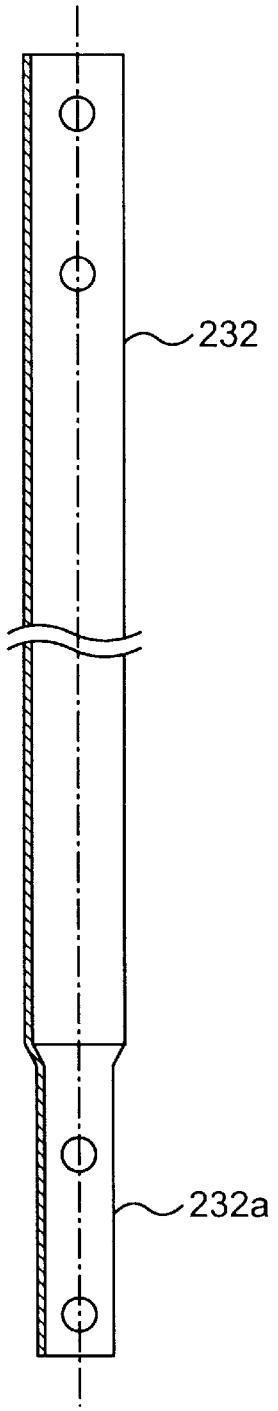
FIG. 15 illustrates a first embodiment of an extension pipe in accordance with the present invention.
Figure 16:
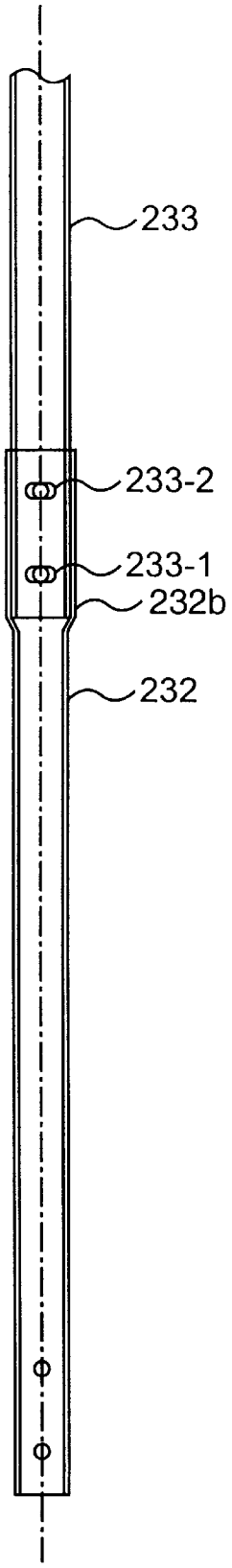
FIG. 16 illustrates a second embodiment of an extension pipe in accordance with the present invention.

The bracket pipe 231, extension pipe 232, and L-shaped pipe 233 may have diameters selected to enable their mutual connection. FIGS. 15 and 16 illustrate two different embodiments of extension pipe 232. In a first embodiment shown in FIG. 15, extension pipe 232 includes an end 232*a* having a narrowed diameter adapter for insertion into bracket pipe 231 or L-shaped pipe 233 to permit connection thereto. The opposite end of extension pipe 232 may be similarly narrowed. FIG. 16 shows that an end 232*b* of extension pipe 232 may have an enlarged diameter for receiving L-shaped pipe 233 to permit connection thereto. The narrowed and enlarged diameters make it easier to properly align holes for inserting bolts, pins, or other fasteners during assembly. Of course, the bracket pipe 231, extension pipe 232, and/or L-shaped pipe 233 may have any diameter or diameters selected to enable their mutual connection.

Figure 17:
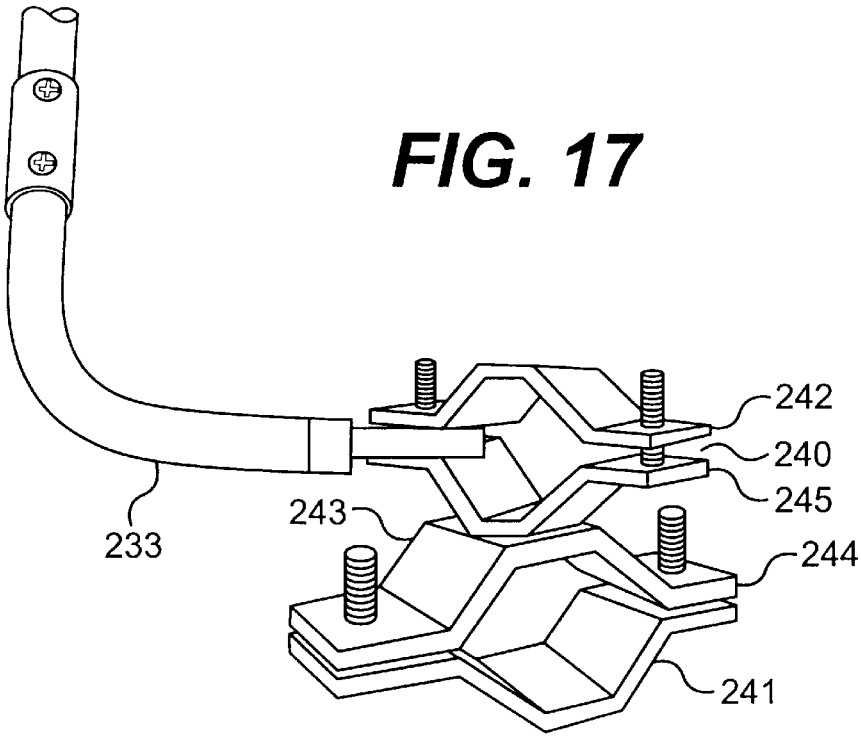
FIGS. 17 and 18 illustrate an integrally-molded double clamp in accordance with the present invention.
Figure 18:
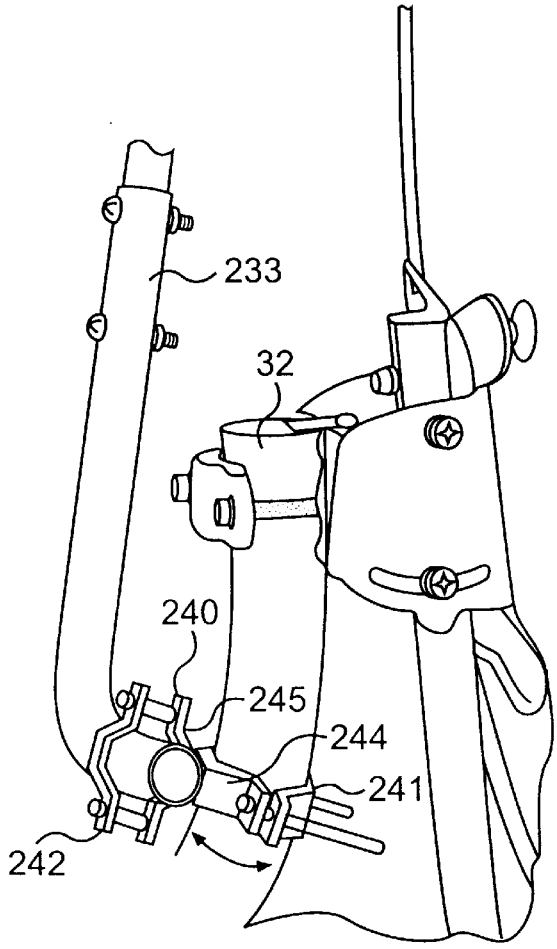

FIGS. 17 and 18 illustrate how integrally-molded double clamp 240 can be used to mount L-shaped pipe 233 to satellite support pipe 32. Double clamp 240 includes a first and second clamp plates 241 and 242, and integrally-molded double clamp plate 243. Integrally-molded double clamp element 243 includes two, oppositely facing clamp plates 244 and 245. By integrally molding clamp plates 244 and 245 together rather than, for example, welding clamp plates 244 and 245 together, clamp element 243 is made mechanically stronger and better able to withstand the stresses and strains imparted to it during outdoor use. Clamp plate 241 mounts to clamp plate 244 to form a first clamp and clamp plate 242 mounts to clamp plate 245 to form a second clamp. In each case, bolts, pins, or other connectors may be used to secure the clamp plates together.

When assembled, clamp plates 241 and 244 form an aperture that is narrower than the diameter of satellite support pipe 32 so that satellite support pipe 32 can be clamped between clamp plates 241 and 244, as shown in FIG. 18. Similarly, clamp plates 242 and 245 form an aperture when assembled together that is narrower than the diameter of L-shaped pipe 233 so that L-shaped pipe 233 can be clamped between clamp plates 242 and 245, as shown in FIGS. 17 and 18. Oppositely-facing clamp plates 244 and 245 are preferable formed transverse to each other so that, when connecting the satellite support pipe 32 to L-shaped pipe 233, satellite support pipe 32 is transverse to at least part of L-shaped pipe 233.

Figure 19A:
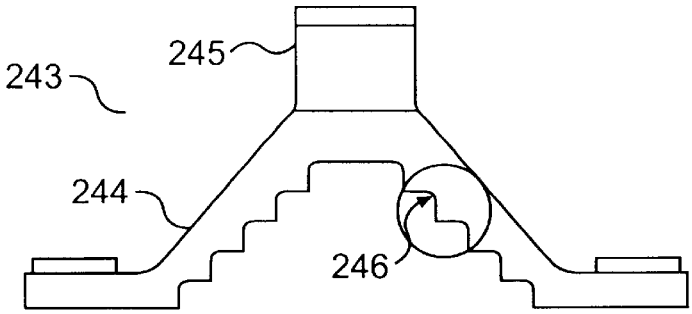
FIGS. 19A–19C illustrate a portion of the integrally-molded double clamp of FIGS. 17 and 18.
Figure 19B:
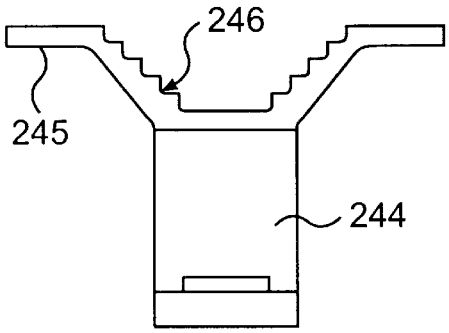
Figure 19C:
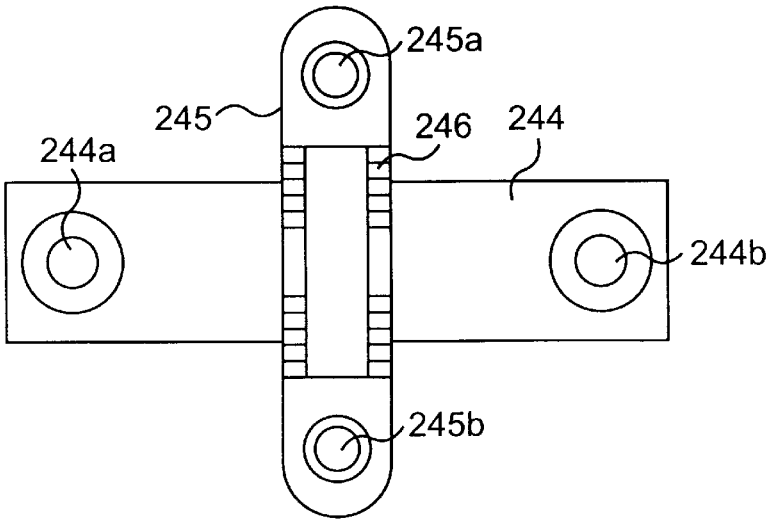

FIGS. 19A–19C illustrate integrally-molded double clamp plate 243. As shown in these Figures, integrally-molded double clamp plate 243 includes oppositely-facing clamp plates 244 and 245 molded or cast as a single unit. The integrally-molded double clamp 240 is therefore mechanically stronger than clamps in which two clamp plates are secured together. The mechanical strength of the double clamp 240 is particularly important in outdoor applications, where the local antenna system is exposed to strong winds and other environmental forces that produce stress between the support pipe 200 and satellite dish support pipe 32. Each of clamp plates 244 and 245 includes ridges 246 on a surface for engaging the support pipes. The troughs between the ridges 246 of claim plate 244 may have a radius, for example, of 3.5 mm. Clamp plates 241 and 242 may have the same general design as clamp plates 244 and 245 and, therefore, are not shown separately. For example, clamp plates 241 and 242 may have corresponding ridges (not shown). Each of the clamp plates 241, 242, 244, and 245 include a pair of holes for receiving bolts, pins, or other connectors. The holes 244*a*, 244*b* of clamp plate 244 and holes 245*a*, 245*b* of clamp plate 245 are best shown in FIG. 19C. The holes on some or all of the clamp plates may be threaded to receive bolts for securing the clamp plates together.

Figure 20:
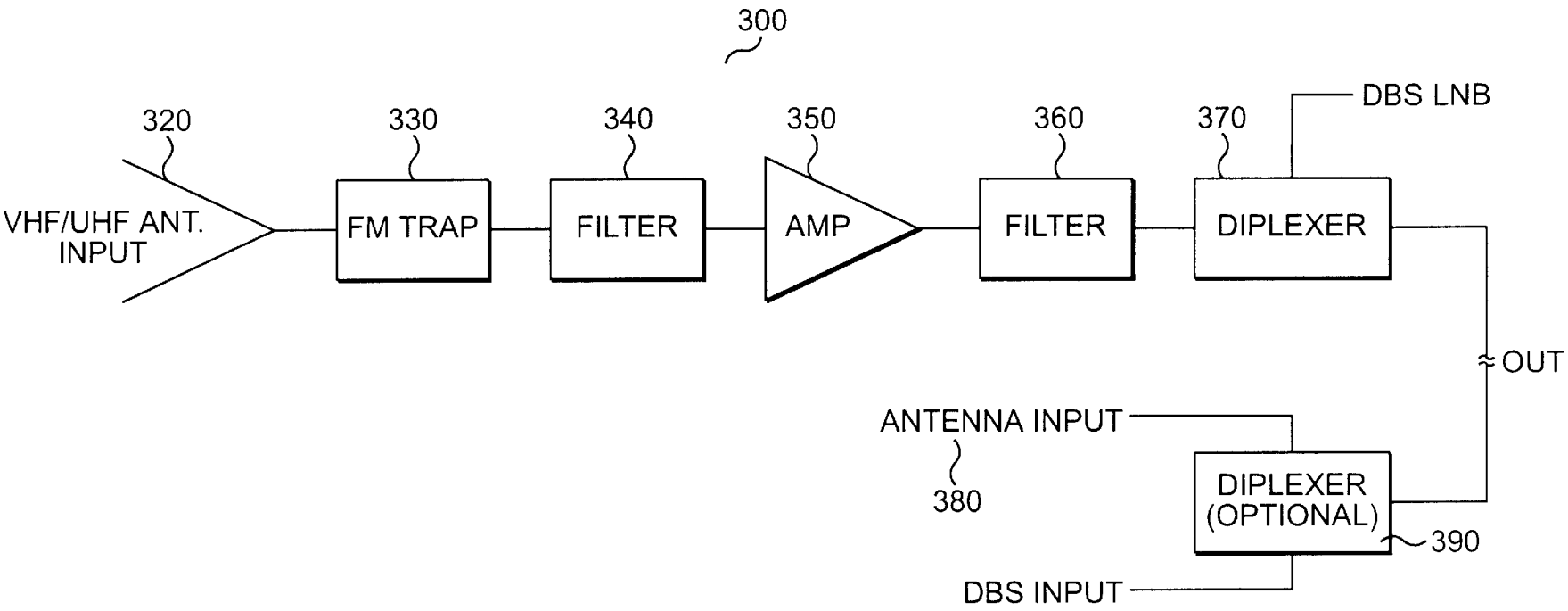
FIG. 20 provides a block diagram illustrating receiving circuitry for receiving a local broadcast television signal and for combining the received local broadcast television signal with a satellite television signal.

FIG. 20 illustrates a block diagram of circuit components of receiving circuitry 300 in accordance with the present invention. As noted above, the receiving circuitry 300 is preferably formed on a circuit board 310, but of course other arrangements are possible. Receiving circuitry includes an antenna input 320, for example, a VHF/UHF antenna input. The antenna input 320 may be coupled to antennas 120, 130 and/or to the antenna elements formed by wire paths 141, 143. The antenna input 320 is coupled to an FM trap 330. FM trap 330 may be a band pass filter for filtering signals in the FM transmission frequency range, which may otherwise excessively drive amplification circuitry of the receiving circuitry 300. Thus, the FM trap 330 ensures that dynamic range of the amplification circuitry is available to handle the received VHF/UHF television transmission.

The output of FM trap 330 is supplied to a filter 340. Filter 340 may be a high pass filter having a pass band above 50 MHz, for example, for filtering unwanted CB or Ham radio band signals (e.g., 1.8–30 MHz). The output of filter 340 is supplied to low noise amplifier 350, which amplifies the signal it receives. Fluctuations in the supply voltage can alter the gain of the amplifier 350. Accordingly, low noise amplifier 350 may receive power from a DC voltage regulator (not shown) which maintains the DC supply voltage to amplifier 350 constant, even if the voltage of the power source fluctuates. A filter 360 filters the amplified signal. Filter 360 may be a low pass filter that selectively filters out unwanted signals from such devices as pocket pagers and other commercial services that would interfere with the satellite system signals if not blocked out. The output of filter 360 is supplied to diplexer 370. Diplexer 370 also receives a satellite signal input from satellite dish 30. Diplexer 370 combines the processed VHF/UHF signal input from filter 360, for example, and a satellite signal from the satellite dish 30 to produce a composite signal. The filter 360 may be constructed as part of the diplexer 370. The composite signal may be routed via a coaxial cable or other suitable signal path to a satellite receiver or set top box within a subscriber's home.

Figure 21:
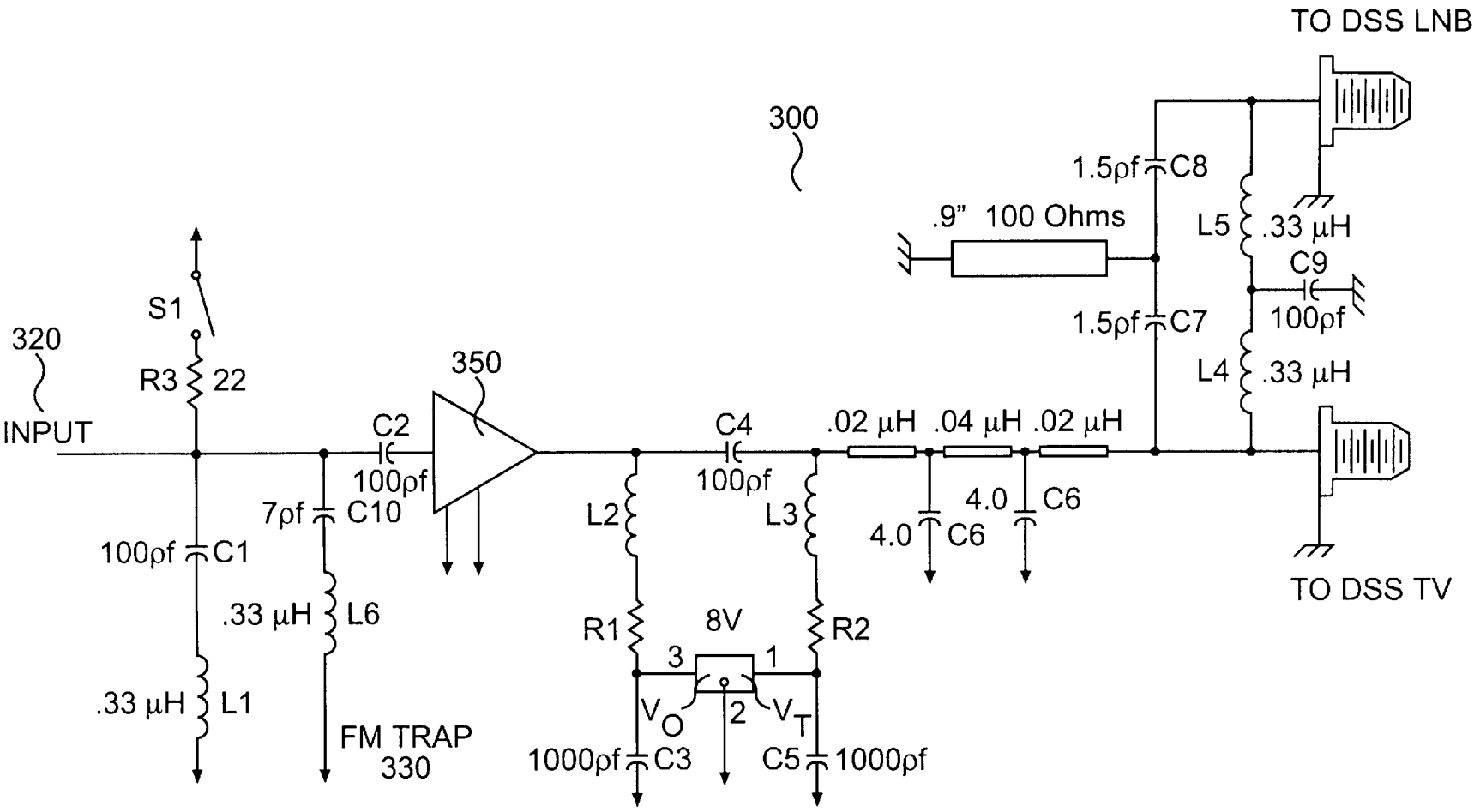
FIG. 21 provides an electrical schematic diagram illustrating receiving circuitry for receiving a local broadcast television signal and for combining the received local broadcast television signal with a satellite television signal.

The receiving circuitry 300 may include an additional antenna input 380, satellite signal input, and diplexer 390. FIG. 21 shows one example of an electrical schematic of the receiving circuitry of FIG. 20 for receiving a local broadcast television signal at the antenna input 320 and combining the received local broadcast television signal with a satellite television signal.

Figure 22:
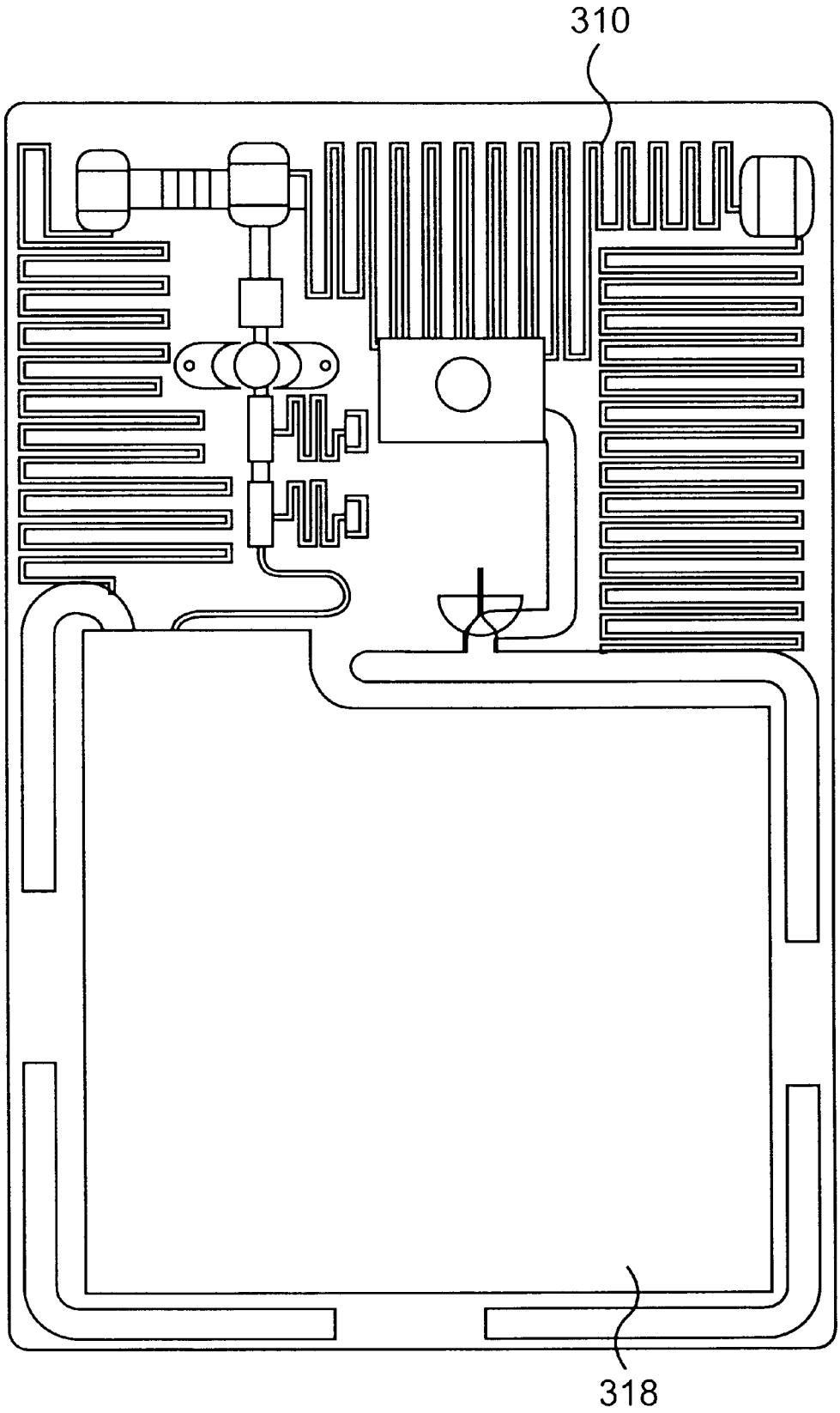
FIG. 22 illustrates an embodiment of circuit board having shielding for protecting the system from interference from external sources.

Further, the receiving circuitry 330 may include shielding 318 as shown in FIG. 22. The shielding protects the VHF/UHF television signals and satellite signals from interference that may arise from a variety of external sources. Power for the receiving circuitry 300 may be tapped from the power supply of the satellite receiving system. Accordingly, no additional power supply for the receiving circuitry 300 is required. Of course, a separate power supply may be provided if desired.

The receiving circuitry 300 may further include a switch as shown as S1 in the receiving circuitry schematic FIG. 21. The switch S1 may be used to selectably tune the omnidirectional antenna sensitivity for local or distal signals. For example, the switch may couple an attenuator providing, for example, 16 dB attenuation of the received local television signals, into the receiving circuitry 300 to prevent amplifier overload. This switch S1 may be mounted to the antenna plate 110 for easy user access. As noted above, the electronic circuit components shown, for example in FIGS. 20 and 21 may be provided on a circuit board 310 housed within antenna plate 110.

It will be apparent to those skilled in the art that various modifications and variations can be made without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A local television antenna comprising:

an omnidirectional antenna for receiving a local broadcast television signal;

a mounting support for mounting the omnidirectional antenna to a mounting support for a satellite television dish, said mounting support comprising an integrally-molded double clamp; and local broadcast television receiving circuitry for processing the local broadcast television signal, said receiving circuitry including an integrated diplexer for combining the processed local broadcast television signal with a satellite television signal to produce a composite signal, wherein said omnidirectional antenna includes an antenna plate and first and second antennas extending from said antenna plate, said antenna plate having a first wiring path connecting said first antenna to said local broadcast television receiving circuitry and a second wiring path connecting said second antenna to said local broadcast television receiving circuitry, wherein said first wiring path comprises a first antenna loop and said second wiring path comprises a second antenna loop, and wherein said antenna plate further comprises a plurality of bosses extending from a surface thereof and wherein said first and second wiring paths are threaded between pairs of said bosses to form said first and second antenna loops, respectively.

2. A local television antenna according to claim 1, wherein said omnidirectional antenna comprises an antenna plate and first and second antennas extending from said antenna plate, wherein said first and second antennas have curled ends.

3. A local television antenna according to claim 1, wherein said antenna plate houses said local television broadcast receiving circuitry.

4. A local television antenna according to claim 1, wherein said local broadcast receiving circuitry comprises a circuit board mounted to said omnidirectional antenna and electrical shielding surrounding said circuit board.

5. A local television antenna according to claim 1, wherein said local broadcast television receiving circuitry includes a second diplexer for combining the processed local broadcast television signal with a second satellite television signal to produce a second composite signal.

6. A local television antenna comprising:

an omnidirectional antenna for receiving a local broadcast television signal;

a mounting support for mounting the omnidirectional antenna to a mounting support for a satellite television dish, said mounting support comprising an integrally-molded double clamp; and local broadcast television receiving circuitry for processing the local broadcast television signal, said receiving circuitry including an integrated diplexer for combining the processed local broadcast television signal with a satellite television signal to produce a composite signal, wherein said mounting support further comprises first and second brackets, said first bracket having leg extensions secured to said omnidirectional antenna and said second bracket having leg extensions secured to said omnidirectional antenna transverse to the leg extensions of said first bracket.

7. A local television antenna according to claim 6, wherein said mounting support further comprises a support pipe, wherein said first and second brackets couple a first end of said support pipe to said omnidirectional antenna and said integrally-molded double clamp secures a second end of said support pipe to the mounting support of the satellite dish.

8. A local television antenna according to claim 7, wherein said first bracket further comprises a sleeve for receiving said support pipe, and said second bracket comprises a sleeve for receiving said sleeve of said first bracket.

9. A local television antenna according to claim 8, wherein said second bracket further comprises triangular flairs joining said sleeve to said leg extensions.

10. A local television antenna according to claim 7, wherein said support pipe comprises a first pipe and a second pipe having a portion inserted into said first pipe, and further comprising adjustable securing means for adjustably securing said first pipe to said second pipe to permit said first pipe to be rotatably adjusted relative to said second pipe.

11. A local television antenna according to claim 10, wherein said adjustable securing means comprises slots formed in an end of said first pipe for receiving said second pipe.

12. A local television antenna according to claim 6, wherein said omnidirectional antenna comprises an antenna plate and first and second antennas extending from said antenna plate, wherein said first and second antennas have curled ends.

13. A local television antenna according to claim 6, wherein said omnidirectional antenna includes an antenna plate and first and second antennas extending from said antenna plate, said antenna plate having a first wiring path connecting said first antenna to said local broadcast television receiving circuitry and a second wiring path connecting said second antenna to said local broadcast television receiving circuitry.

14. A local television antenna according to claim 13, wherein said first wiring path comprises a first antenna loop and said second wiring path comprises a second antenna loop.

15. A local television antenna according to claim 6, wherein said local broadcast receiving circuitry comprises a circuit board mounted to said omnidirectional antenna and electrical shielding surrounding said circuit board.

16. A local television antenna according to claim 6, wherein said local broadcast television receiving circuitry includes a second diplexer for combining the processed local broadcast television signal with a second satellite television signal to produce a second composite signal.

* * * * *